US005975235A

United States Patent [19]

Schlaegel et al.

[11] Patent Number: 5,975,235

[45] Date of Patent: Nov. 2, 1999

[54] SEATING MEMBER FOR CONNECTING A CONTINUOUS-FLOW EARMOLD TUBING CONNECTOR TO AN EARMOLD

[76] Inventors: Norman D. Schlaegel, 34439 Bentley Pl., Fremont, Calif. 94555; Chester J. Jelonek, 2704 Glascow Ct., Richmond, Calif. 94806

[21] Appl. No.: 09/013,282

[22] Filed: Jan. 26, 1998

Related U.S. Application Data

[63] Continuation-in-part of application No. 08/546,702, Oct. 23, 1995, Pat. No. 5,753,870.

[51] Int. Cl.[6] ..... H04R 25/00

[52] U.S. Cl. ..... 181/129; 181/130; 381/312

[58] Field of Search ..... 181/129, 130, 181/135; 381/313, 316, 320, 321, 322, 328, 330, 312

[56] References Cited

U.S. PATENT DOCUMENTS 3,813,499 5/1974 Vignini ..... 181/129

4,381,830 5/1983 Jelonek ..... 181/129

5,488,205 1/1996 Major ..... 181/129

*Primary Examiner*—Khanh Dang

*Attorney, Agent, or Firm*—Adrian J. LaRue

[57] ABSTRACT

A connector connects sound-conduction tubing from a hearing aid to sound-conduction bore in an earmold. The connector is an elbow-shaped member with one end receiving an end of the sound-conduction tubing while the other end has latching means that latchably mate with a seating member disposed in an entry section of the sound-conduction bore. The inside diameter of the sound-conduction tubing, the diameter of the sound-conduction tubular passage in the elbow-shaped member and the diameter of the sound-conduction bore are the same therealong thereby defining a continuous-flow sound-conduction path from the hearing aid to the end of a canal of the earmold. A filter can be disposed in the one end of the connector with the sound-conduction tubing engaging the filter.

7 Claims, 3 Drawing Sheets

SEATING MEMBER FOR CONNECTING A CONTINUOUS-FLOW EARMOLD TUBING CONNECTOR TO AN EARMOLD

CROSS-REFERENCE TO RELATED APPLICATION

This application is a continuation-in-part application of U.S. patent application Ser. No. 08/546,702 filed Oct. 23, 1995, now U.S. Pat. No. 5,753,870.

FIELD OF THE INVENTION

The present invention relates to connectors and more particularly to a seating member in a sound-conduction opening in an earmold for connecting a connector to the sound-conduction opening in the earmold.

BACKGROUND OF THE INVENTION

U.S. Pat. No. 4,381,830 discloses a continuous flow earmold tubing connector or continuous flow adapted (CFA) that connects sound conduction tubing from an ear hook of a hearing aid to an earmold that fits within a person's ear. The important feature of the invention disclosed in the patent is the diameter of the sound conduction passage in the connector or adaptor is the same as the internal diameter of the sound conduction tubing. This provides a smooth and continuous path along the sound-conduction tubing and the connector from the hearing aid to the earmold whereby the acoustical characteristics of amplified sound emanating from the hearing aid and traveling along the smooth and continuous path into the ear is not changed thereby resulting in improved amplified sound reaching the ear.

Whereas the CFA improves the amplified sound reaching the ear from the hearing aid, it is desirable to better shape the output and increase the gain from the hearing aid to achieve desired electroacoustic effects for persons wearing the hearing aids.

SUMMARY OF THE INVENTION

An object of the present invention is to provide a connector including a filter therein for connecting sound-conduction tubing from a hearing aid to a sound-conduction passage of an earmold with the filter acting to better shape the output and increase the gain from the hearing aid.

Another object of the present invention is the provision of a connector having a bore at one end in which a filter is positoned and an end of a sound-conduction tubing from a hearing aid with the sound-conduction tubular passage extending through the connector having a diameter the same as the internal diameter of the sound-conduction tubing.

A further object of the present invention is to provide a seating member that is secured in an outer section of a sound-conduction bore of an earmold in which a barbed nubbin of an elbow-shaped connector is mounted.

The present invention is realized by an elbow-shaped connector having a sound-conduction tubular passage therealong which has the same diameter along its length. One leg of the elbow-shaped connector has a tubing-receiving section for receiving an end of a sound-conduction tubing therein; the internal diameter of the sound-conduction tubing is the same as the diameter of the sound-conduction tubular passage in the elbow-shaped connector. The other leg of the elbow-shaped connector has a nubbin having a conically-shaped barb for insertion in a seating member secured in an outer section of a sound-conduction bore of an earmold.

The foregoing and other objects and advantages of the invention will more fully appear from the following description by way of example of embodiments of the invention when taken in connection with the accompanying drawings.

DETAILED DESCRIPTION OF THE INVENTION

Figure 1:
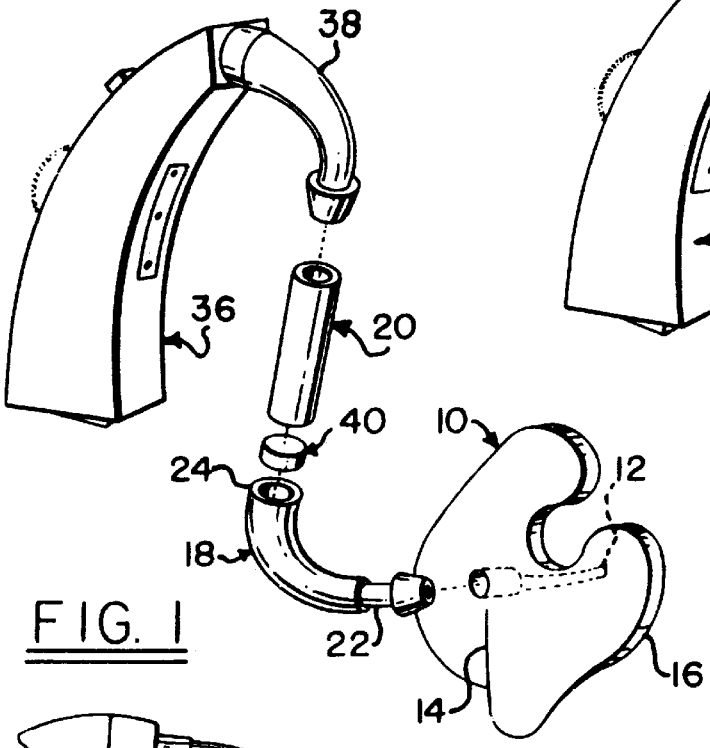
FIG. 1 is a perspective and exploded view of an earmold, earmold-tubing connector, sound-conduction tubing, filter and hearing aid.

A conventional earmold 10 is molded from a suitable plastic material to conform to and frictionally fit within a person's ear. The earmold is a pliable plastic that is compressible when finger and thumb pressure is applied thereto which classifies it as a soft plastic material. The earmold can also be made of a hard plastic material such as Lucite plastic.

The earmold 10 includes a sound-conduction or sound bore 12 extending from the bridge 14 and through the canal 16 which extends into the ear canal. The outer part of sound-conduction bore 12 has a nubbin-receiving section defining section 12*a* having a diameter larger than bore 12 and a section 12*b* in the form of a frustum of a cone; bore 12 has the same diameter therealong from section 12*b* to the end of canal 16.

A connector 18 is molded from a suitable plastic material such as clear vinyl. It is elbow-shaped and has a bend of about 80 degrees for a better fit into sections 12*a* and 12*b* of bore 12, retention of the connector therein and orientation to receive one end of sound-conduction tubing 20 therein which is also made of clear vinyl plastic like connector 18.

Connector 18 has a nubbin 22 at one end and a tubing-receiving section 24 at the other end. Tubing-receiving section 24 has a bore 26 that has a diameter only slightly larger than the outside diameter of sound-conduction tubing 20 so that tubing 20 can be readily fitted within bore 26 against filter 40 which abuts shoulder 28 with a conventional vinyl glue being used if desired to secure tubing 20 within connector 18. Normally, tubing 20 is not secured in connector 18 so that the filter can be removed for cleaning.

A sound-conduction tubular passage 30 extends through connector 18 from bore 26 to the outer end of nubbin 22 and its diameter is the same as the inside diameter of sound-conduction tubing 20 thereby defining a sound-conduction path having the same diameter therealong.

Nubbin 22 has an annular recess 32 and a conically-shaped barb 34 which mate with and conform to sections 12*a* and 12*b* respectively of sound-conduction bore 12 in earmold 10 when nubbin 22 is force fitted into the nubbin-receiving section of bore 12. This can be done because connector 12 is flexible and nubbin 22 can be fitted into the nubbin-receiving section.

When nubbin 22 is fitted into the nubbin-receiving section of bore 12 so that reduced-diameter surface 32 fits with section 12*a* and conically-shaped barb 34 fits within section 12*b*, a sealed connection is made and nubbin 22 is latchably secured with the nubbin-receiving section of bore 12 to connect sound-conduction tubing 20 to the sound-conduction bore 12 of earmold 10. This arrangement enables connector 18 to be easily unlatched from the earmold to enable tubing 20, connector 18 and bore 12 to be cleaned.

The diameter of bore 12 from section 12*b* to the outer end of canal 16 is the same as sound-conduction tubular passage 30. Thus, when tubing 20 is secured within bore 26 of connector 18 and nubbin 22 is latchably connected within sections 12*a* and 12*b* of bore 12, a sound-conduction path of the same diameter extends therealong which does not change the acoustical characteristics of amplified sound emanating from hearing aid 36 which has its ear hook 38 connected onto sound-conduction tubing 20. Hearing aid 36 can be a behind the ear or spectacles hearing aid. The sound-conduction passageway 37 in the ear hook 38 and in the spectacles hearing aid has a diameter the same as the internal diameter of the sound-conduction tubing. In this way, the fidelity of the frequencies of sound signals amplified by the hearing aid are more true because the sound-conduction path along the sound-conduction tubular passage and the sound-conduction bore has the same diameter therealong.

Whereas, the sound-conduction path along the sound-conduction passageway 37 of the ear hook 38, the sound-conduction tubing 20, the sound-conduction tubular passage 30 of the connector 18 and the sound-conduction bore 18 of the earmold 10 has the same diameter therealong, this results in the fidelity of the frequencies of sound signals amplified by the hearing aid being more true. Adding filter 40 within bore 26 of connector 18 at the end of sound-conduction tubing 20 more effectively shapes the output and gain of the amplified signals from the hearing aid 36 thereby achieving much better electroacoustic effects.

Figure 4:
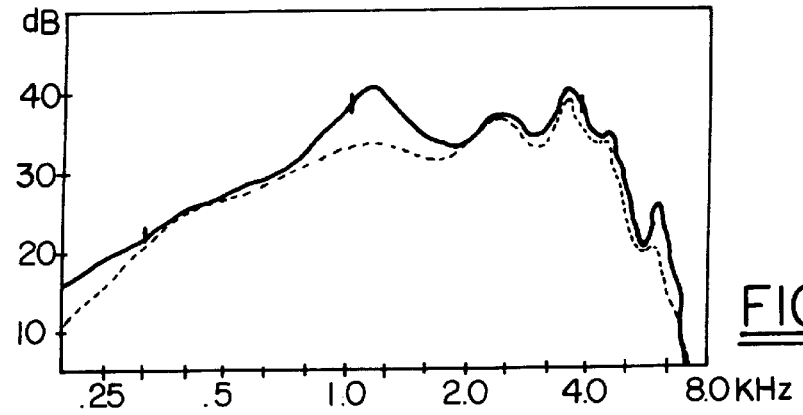
FIG. 4 is a graph showing the gain measurement in the presence of a speech weighted composite signal of 70 dB input when using a standard continuous-flow adapter (CFA) and tubing when compared with a 680 ohms filtered CFA and tubing.
Figure 6:
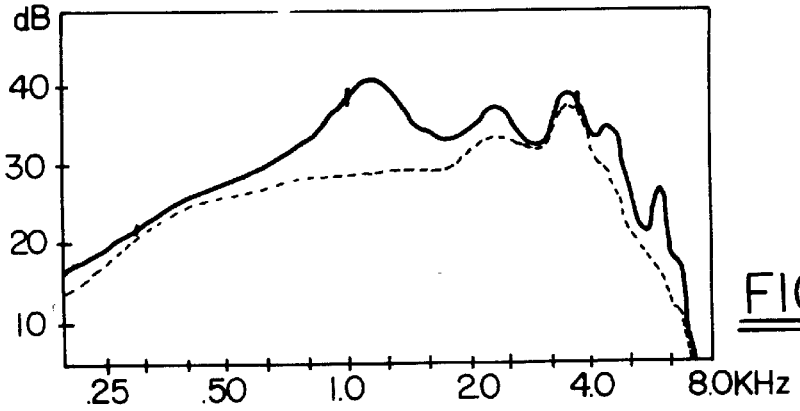
FIG. 6 is a graph similar to FIG. 4 showing the gain measurement in the presence of a speech-weighted composite signal of the 70 dB input when using a standard CFA and tubing when compared with a 1500 ohms filtered CFA and tubing.

As shown in the graph depicted in FIG. 4, the upper curve shows the gain measurement operational characteristics of a hearing aid using a standard continuous-flow adapter without the use of filter 40 of a speech-weighted composite signal at a 70 dB input within a frequency of 0 to 8 kilohertz. The bottom curve of FIG. 4 shows the use of filter 40 of 680 ohms, whereby the curve is much smoother in the 1 kilohertz range. A similar situation occurs when the filter 40 is 1500 ohms as shown in the graph of FIG. 6 with the upper curve showing the gain measurement when using a standard continuous-flow adapter without the use of filter 40 of the same speech-weighted composite signals at a 70 dB input; whereas the bottom curve shows the use of a filter 40 of 1500 ohms.

Figure 5:
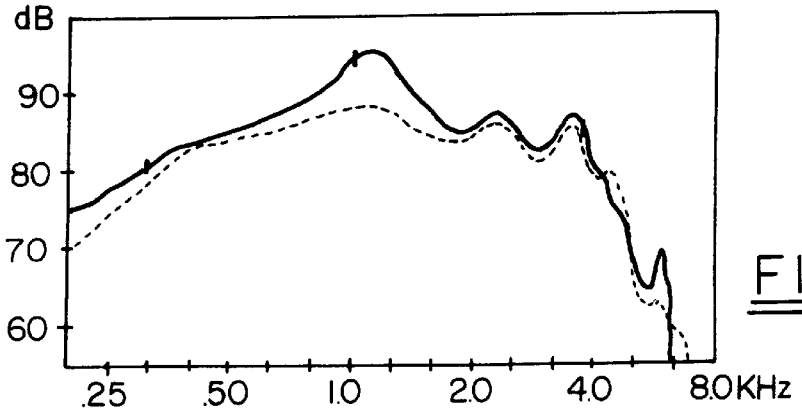
FIG. 5 is a graph similar to FIG. 4 showing the output measurement in the presence of a speech-weighted composite signal of the 70 dB input when using a standard CFA and tubing when compared with a 680 ohms filtered CFA and tubing.
Figure 7:
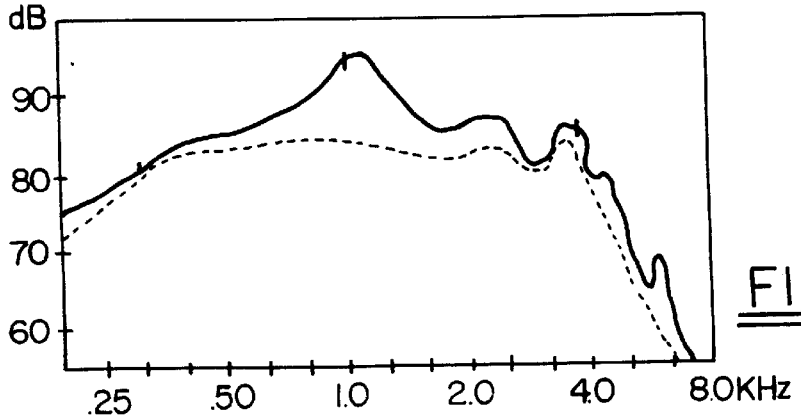
FIG. 7 is a graph similar to FIG. 4 showing the output measurement in the presence of a speech-weighted composite signal of 70 dB input when using a standard CFA adapter and tubing when compared with a 1500 ohms filtered CFA and tubing.

FIGS. 5 and 7 shows the graphs of the output measurement of a hearing aid when a speech-weighted composite signal of 70 dB input is applied to a hearing aid. The upper curves in these graphs show the output measurement when the hearing aid uses a standard continuous-flow adapter without a 680 ohms or 1500 ohms filter; whereas the bottom curves of these graphs show the use of a filter 40 of 680 ohms and 1500 ohms as part of the continuous-flow adapter.

The invention has been described as having a filter of 680 and 1500 ohms. Other filters having a desired resistance can be used in accordance with the specific needs. These filters are conventional and are manufactured by Knowles Electronics, Inc., Itasco, Ill.

Figure 2:
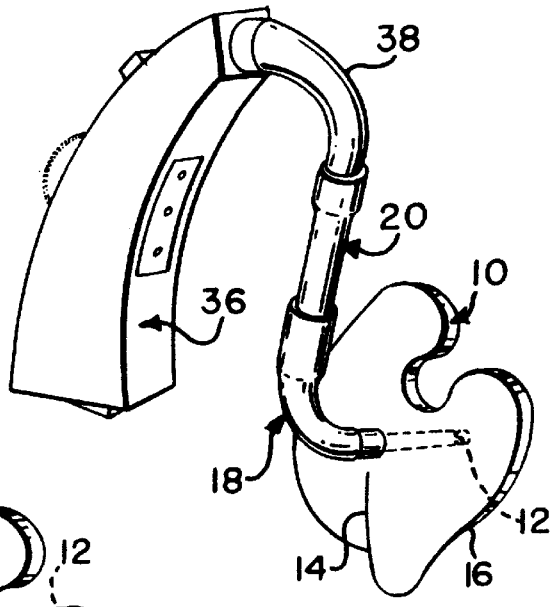
FIG. 2 is a view similar to FIG. 1 with the parts assembled together.
Figure 3:
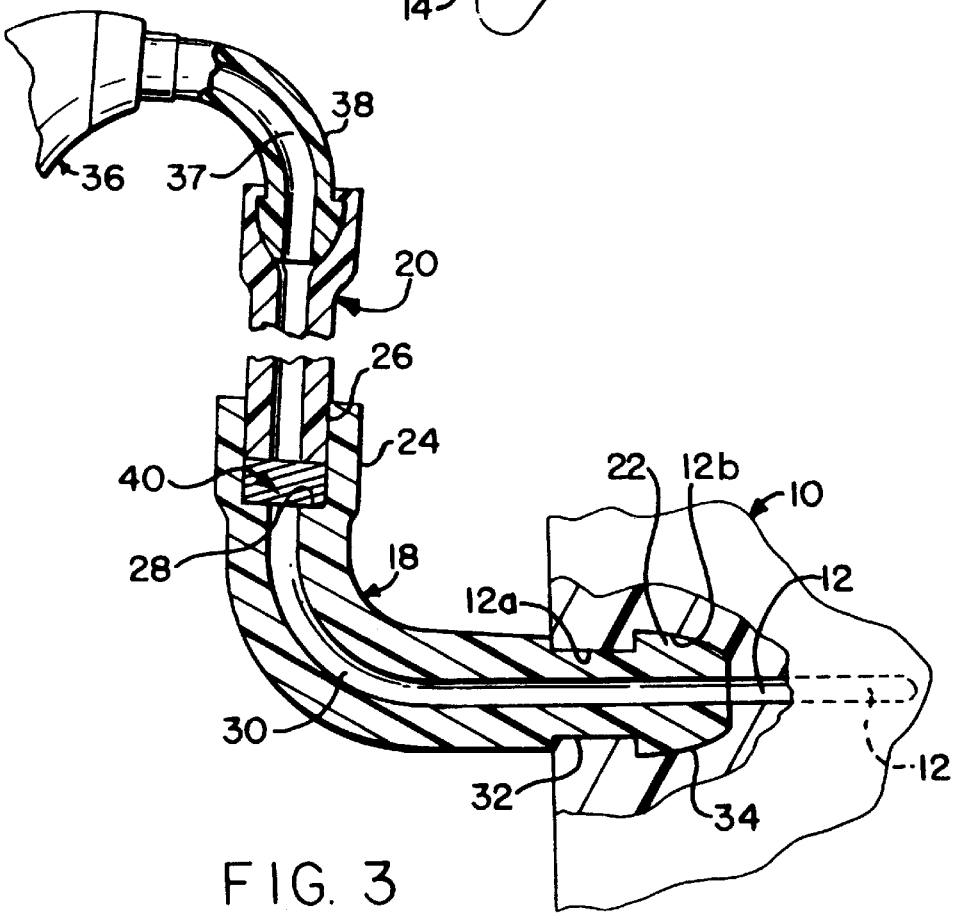
FIG. 3 is a cross-sectional view of part of the earmold, earmold-tubing connector, filter, sound-conduction tubing and part of the hearing aid.
Figure 8:
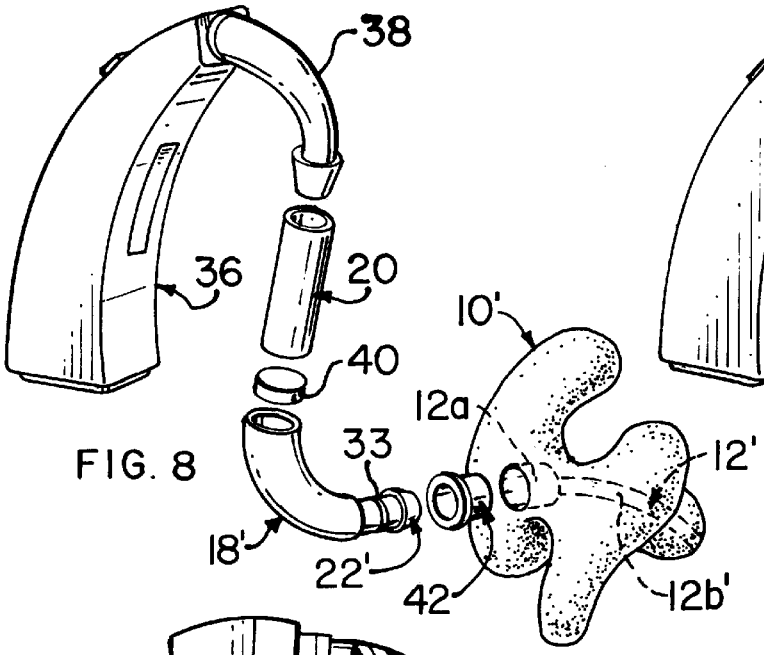
FIG. 8 is an exploded perspective view of an alternative embodiment of the present invention.
Figure 9:
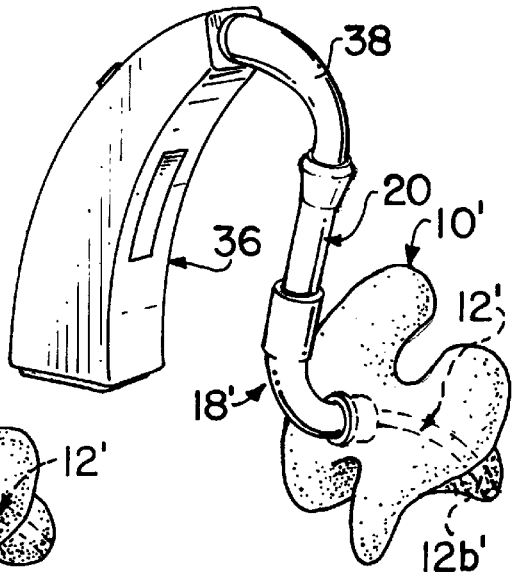
FIG. 9 is a view similar to FIG. 8 showing an assembled hearing aid system.
Figure 10:
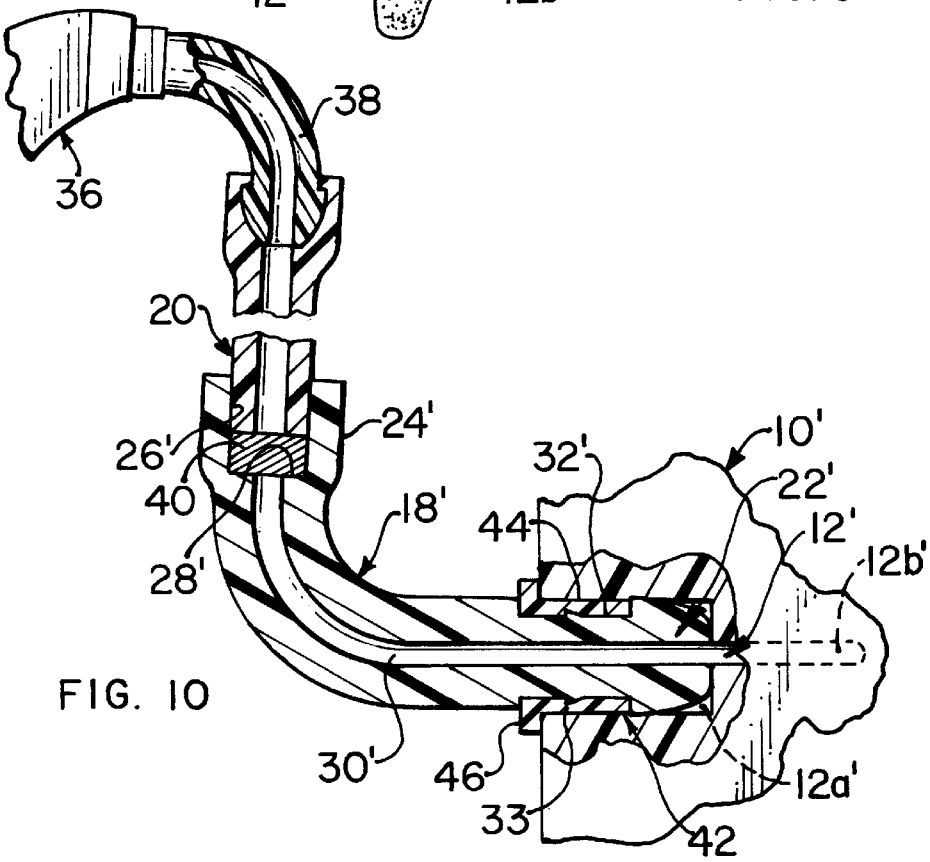
FIG. 10 is a cross-sectional view of part of the earmold, seating-member, earmold-tubing connector, filter, sound-conduction tubing and part of the hearing aid.

FIGS. 8–10 show an alternative embodiment of a hearing aid system similar to that as shown in FIGS. 1–3 wherein the same components are identical with the exception of earmold 10' and connector 18' which are slightly different as explained hereafter.

Sound-conduction bore 12' of earmold 10' has an outer section 12'*a* having a diameter larger than sound-conducting bore 12'*b* which extends from outer section 12'*a* to the end of earmold 10' which extends into the ear channel. The diameter of sound-conducting bore 12'*b* is the same as that of sound-conduction tubular passage 30' of connector 18' that extends from bore 26' to the outer end of nubbin 22'.

Nubbin 22' has a generally conical shape with the outer surface being arcuate or it can be tapered as desired. An annular recess 32' is located rearward of nubbin 22' and includes an annular barb 33 which has a tapered inner surface and a vertical outer surface.

Seating member 42 has an annular section 44 and an annular shoulder 46 at an outer end. Seating member 42 is made from a suitable plastic and it is secured in outer section 12'*a* of sound-conduction bore 12' as shown in FIGS. 9 and 10 with annular section 44 disposed in outer section 12'*a* and annular shoulder 46 abutting against a surface of earmold 10' thereby limiting the movement of annular section 44 within outer section 12'*a* so that a space is provided within outer section 12'*a* from an inner end of annular section 44 to an inner end of outer section 12'*a* as shown in FIG. 10. The outer diameter of annular section 44 is about the same as that of outer section 12'*a* so that annular section 44 fits snugly therein and a conventional adhesive can be used to secure seating member 42 in position in outer section 12'*a*.

Connector 18' is mounted in sound-conduction bore 12' of earmold 10' as shown in FIGS. 9 and 10 with nubbin 22' extending through seating member 42 and being disposed in the space within outer section 12'*a* with an inner surface engaging the inner end of seating member 42, annular barb 33 bitingly engages an inner surface of seating member 42, and an outer surface of annular recess 32' engages annular shoulder 46. Thus, the nubbin end of connector 18' is latchably secured in seating member 42 thereby positively maintaining connector 18' within earmold 10'.

Thus, nubbin 22' in conjunction with annular barb 33 provide better latching of connector 18 with earmold 10'. This arrangement also allows for less leakage of sound.

As in the embodiment of FIGS. 1–3, tubing-receiving section 24' has a bore 26' that has a diameter only slightly larger than the outside diameter of sound-conduction tubing 20 so that tubing 20 can be readily fitted within bore 26' against filter 40 which abuts shoulder 28' with a conventional vinyl glue being used to secure sound-conduction tubing 20 within connector 18' thereby maintaining filter 40 at a specific location within connector 18'. The other end of sound-conduction tubing 20 is connected to the ear hook 38 of hearing aid 36.

The hearing aid system of FIGS. 8–10 operates in the same manner as that of FIGS. 1–3. Filter 40 can be omitted from the hearing aid system of FIGS. 8–10.

From the foregoing, it can be discerned that the use of a filter in a continuous-flow adapter as part of a hearing aid system smoothes the frequency response and gives a more acoustically-comfortable performance. This permits operation at higher average sound pressure levels with substantially improved effectiveness to the hearing impaired. Also, a seating member is located in an outer section of a sound-conduction bore of an earmold which serves to latchably receive a nubbin of a connector therein.

We claim:

1. A hearing aid system, comprising:

a hearing aid having sound-conduction means;

a sound-conduction tubing having a first end connected to said sound-conduction means;

an earmold having a sound-conduction bore extending therethrough, said sound-conduction bore having an entry section and an exit section;

a seating member disposed in said entry section; and a connector member having an elbow configuration and including a tubing-receiving section, a latching section, and a sound-conduction tubular passage extending from said tubing-receiving section to an outer end of the latching section, said latching section mating with said seating member in said entry section of said earmold to latchably secure said connector member in said earmold, said tubing-receiving section having a diameter to receive a second end of said sound-conduction tubing therein.

2. A hearing aid system as claimed in claim 1, wherein an internal diameter of the sound-conduction tubing is the same as a diameter of said sound-conduction tubular passage so that said sound-conduction tubular passage has the same diameter as the exit section of said sound-conduction bore.

3. A hearing aid system as claimed in claim 1, wherein a filter is disposed in said tubing-receiving section adjacent the second end of said sound-conduction tubing.

4. A hearing aid system as claimed in claim 3, wherein said tubing-receiving section has a shoulder against which said filter engages.

5. A hearing aid system as claimed in claim 1, wherein said seating member has an annular section disposed in said entry section and an annular shoulder disposed against said earmold.

6. A hearing aid system as claimed in claim 5, wherein said latching section has an annular recess, an annular barb located in said annular recess engaging an inner surface of said annular section of said seating member.

7. A hearing aid system as claimed in claim 1, wherein a space is provided in said entry section between an inner end of said seating member and an inner surface of said entry section, a nubbin of said latching section is disposed within said space.

* * * * *